3/27/84 XR 4,439,754

United States Patent [19]

Madden, Jr.

[11] 4,439,754

[45] Mar. 27, 1984

[54] APERTURED ELECTRONIC CIRCUIT PACKAGE

[75] Inventor: Jean D. Madden, Jr., Warwick, R.I.

[73] Assignee: Electro-Films, Inc., Warwick, R.I.

[21] Appl. No.: 250,763

[22] Filed: Apr. 3, 1981

[51] Int. Cl.[3] ..... H01C 1/01

[52] U.S. Cl. ..... 338/320; 219/121 CH; 219/121 LJ; 29/610 R; 174/52 FP

[58] Field of Search ..... 29/610 R, 613, 620; 174/52 FP, 52 PE; 338/195, 320, 308, 309, 314, 325; 219/121 LH, 121 LJ; 361/393, 395, 396, 412

[56] References Cited

U.S. PATENT DOCUMENTS

| | | | |
|---|---|---|---|
| 3,634,600 | 1/1972 | Griffin et al. | 174/52 FP |
| 3,699,642 | 10/1972 | McWilliams | 29/610 |
| 3,768,157 | 10/1973 | Buie | 29/613 |
| 3,984,620 | 10/1976 | Robillard et al. | 174/52 FP |

*Primary Examiner*—Roy N. Envall, Jr.
*Assistant Examiner*—M. M. Lateef
*Attorney, Agent, or Firm*—Weingarten, Schurgin, Gagnebin & Hayes

[57] ABSTRACT

An electronic circuit package in which a resistor network is readily installed and remains accessible for laser trimming after final assembly of the package. A substrate is provided having a circuit pattern on a surface thereof and terminating in electrical terminals for connection to external circuitry. The substrate includes an aperture about the periphery of which a plurality of contact pads are arranged and in connection with intended paths of the circuit pattern. A resistor network is formed on a surface of a smaller substrate, the resistors being connected to contact pads disposed about the periphery of the smaller substrate and configured to be in alignment with respective pads at the aperture of the larger substrate. The smaller substrate is placed on the larger substrate with the respective contact pads in alignment, and the engaged contact areas are bonded to mechanically retain the smaller substrate and to electrically interconnect the resistor network with the associated circuit pattern. The network remains accessible by way of the aperture in the larger substrate such that resistors can be laser trimmed after final assembly of the circuit package to achieve an intended and precise specification. After trimming, the network can be protected by an appropriate encapsulating layer.

12 Claims, 4 Drawing Figures

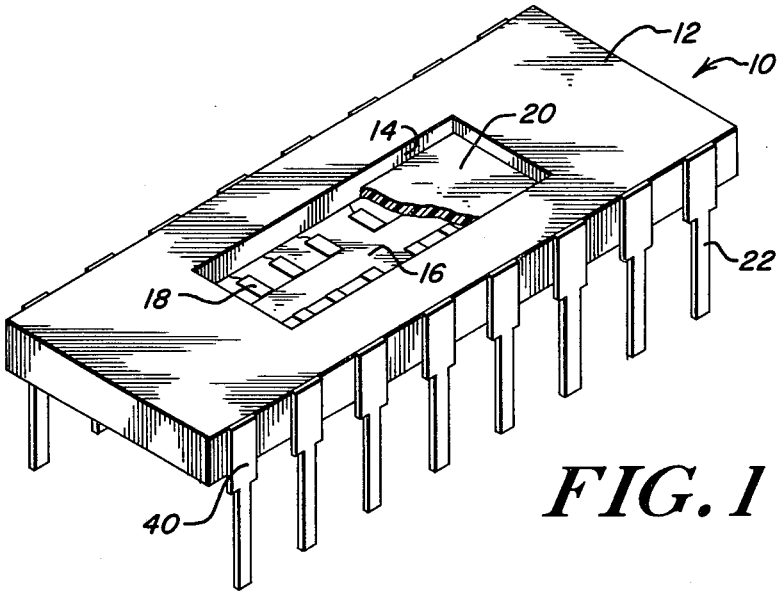
FIG. 1
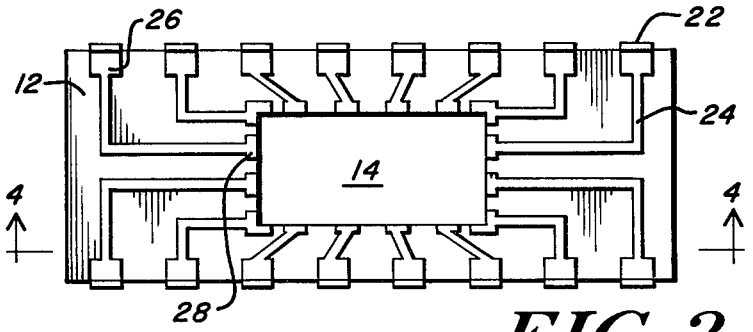
FIG. 2
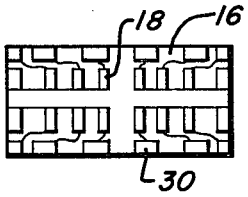
FIG. 3
FIG. 4
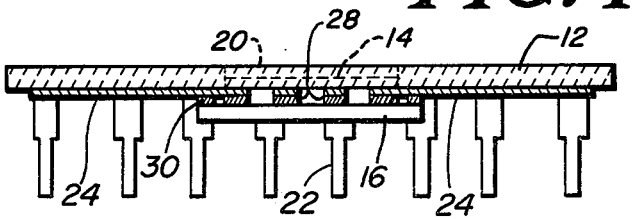

APERTURED ELECTRONIC CIRCUIT PACKAGE

FIELD OF THE INVENTION

This invention relates to electronic circuit packages and more particularly to packages having resistor networks or other components which can be laser trimmed after final assembly, and to a method of manufacture thereof.

BACKGROUND OF THE INVENTION

Film-type resistor networks are often employed in electronic circuits and are usually laser trimmed to desired resistance values. Typically, a network of deposited film resistors is formed on a small ceramic substrate, and after formation the resistors are trimmed by selective volatilization of resistive material caused by laser trimming apparatus to thereby adjust their resistance. The trimmed resistor network is thereafter installed on the substrate of an associated circuit or header containing leads or contacts for connection to external circuitry. Electrical connections between the resistors of the network and corresponding connection points on the associated circuit or header are usually provided by wire bonding. The thus assembled circuit package is then encapsulated or otherwise enclosed for protection. The resistor network is sometimes mounted on a header or a support and thereafter trimmed. Tolerance variations in the overall support can cause variation in the height of the network sufficient to affect the performance of the trimming operation. The height of the network can vary by 0.005 inch or more, as a result of which the laser source will not be in precise focus or must be refocused for the particular network to be trimmed.

It is often disadvantageous that the resistor network must be trimmed prior to final assembly in an associated circuit or header, and cannot be trimmed after such final assembly. As a consequence, while a resistor network can be trimmed to a predetermined specification, the network in association with an overall circuit may not be within intended specification. Similarly, a trimmed network after incorporation into an associated headed may not be precisely within specification by reason of parameter variations caused by the assembly procedure. The use of wire bonding is also a disadvantage in conventional circuit packaging techniques. Manual or semi-automatic wire bonding requires a skilled operator and carefully controlled equipment. Automatic wire bonding requires the use of extremely expensive equipment which requires careful set-up to achieve intended performance. Moreover, the wire bonds are themselves very delicate, and great care must be exercised in enclosing a resulting wire bonded package to prevent breakage of the wires.

SUMMARY OF THE INVENTION

In accordance with the present invention, an electronic circuit package and manufacturing method is provided in which a resistor network or other component or network can be readily installed and wherein the network can be laser trimmed after final assembly of the circuit package. The invention comprises a substrate having a circuit pattern on a surface thereof and terminating in electrical terminals of any convenient arrangement, and typically arranged along one or more edges of the substrate. The substrate includes an aperture about the periphery of which a plurality of contact pads are arranged and respectively connected to intended paths of the circuit pattern. A resistor network is formed by well-known film deposition techniques on a surface of a smaller substrate, the resistors being connected to contact pads disposed about the periphery of the smaller substrate and configured to be in alignment with respective contact pads at the aperture of the larger substrate. The smaller substrate is placed on the larger substrate with the respective contact pads in alignment, and the engaged contact areas are bonded, such as by reflow soldering, to mechanically retain the smaller substrate on the larger substrate board and to electrically interconnect the resistor network with the associated circuit pattern.

The resistor network is accessible by way of the aperture in the larger substrate such that the resistors can be laser trimmed after final assembly of the circuit package to achieve an intended and precise specification. After trimming, the resistor network can be protected by an appropriate encapsulating layer. If desirable, a protective coating can also be provided over the circuit pattern on the larger substrate. The resistor network and associated contact pads are formed on one surface of the smaller substrate, while the circuit pattern and associated contact pads are formed on one surface of the larger substrate. The invention utilizes single layer deposition techniques and is economical to implement. Moreover, assembly of circuit packages according to the invention can be accomplished by automatic assembly equipment. While the invention is disclosed herein for use with laser trimmable resistor networks, it is contemplated that the invention is equally useful for other trimmable or adjustable components or networks which require external access after circuit assembly. For example, the invention can be employed in packaging circuits including a semiconductor read-only memory in which fuseable links of the memory are blown by use of an externally applied current to permanently store predetermined data in intended memory locations.

DESCRIPTION OF THE DRAWING

The invention will be more fully understood from the following detailed description taken in conjunction with the accompanying drawing, wherein:

FIG. 1 is a pictorial view, partly cutaway, of an electronic circuit package according to the invention;

FIG. 2 is a plan view of the apertured substrate employed in the invention;

FIG. 3 is a plan view of the smaller substrate containing the resistor network and employed in the invention; and FIG. 4 is an cross section view of the mated substrates illustrating the attachment of the resistor network to the associated circuit pattern.

DETAILED DESCRIPTION OF THE INVENTION

An electronic circuit package constructed in accordance with the invention is illustrated in preferred embodiment in FIG. 1. The circuit package 10 comprises a substrate 12 of generally rectangular configuration and having a rectangular aperture 14 provided therethrough. The substrate 12 is usually of ceramic and of typical dimensions of 0.3 by 0.78 inch or 0.6 by 1.25 inches. A smaller substrate 16, also usually of ceramic, is mounted on the bottom surface of the substrate 12 and contains a resistor network 18 disposed within the aperture 14 and by which the network is accessible for laser trimming after assembly of the circuit package. A protective coating 20 is provided over the resistor network after the trimming thereof. An array of leads 22 is provided along respective opposite edges of the substrate 12 arranged, in the illustrated embodiment, in the well-known dual-in-line configuration and by which the circuit package is installed into associated circuitry and electrically connected therewith.

A circuit pattern is provided on the bottom surface of substrate 12 as illustrated in FIG. 2. This pattern is composed of conductive paths 24 connected at one end to respective contact portions 26 of leads 22, and at the other end to respective contact pads 28 disposed about the perimeter of aperture 14. The contact portions 26 extend onto the edge of substrate 12, the edge portions being bonded to the respective leads 22. Other lead configurations can be provided to suit intended requirements. The contact portions 26 can also reside solely on the substrate surface and to which leads are affixed. Moreover, the contact portions 26 can, themselves, serve as electrical terminals, such as for bonding to respective contact areas of an associated circuit board. In the illustrated embodiment, the circuit pattern is a pattern of conductive paths providing connection of the resistor network to the package leads. Alternatively, the circuit pattern can be a pattern of other electronic components and can be, for example, a hybrid electronic circuit containing integrated circuits and discrete elements and to which the resistor network is connected.

The smaller substrate is illustrated in FIG. 3 and includes a plurality of film resistors 18 connected in an intended resistor network configuration and also connected to contact pads 30 disposed about the periphery of the substrate surface and in alignment with respective contact pads 28 of the substrate 12 (FIG. 2). To assemble the circuit package, the smaller substrate 16 is disposed over the aperture of the larger substrate 12 with the contact pads 30 in engagement with respective pads 28, as shown in FIG. 4. A mechanical and electrical bond is provided between the engaged pad areas such as by reflow soldering or brazing to thereby mechanically mount the resistor network within the circuit package and to provide electrical connection of the network with the associated circuit pattern. The resistors of the network are visible and accessible within the aperture 14, as seen in FIG. 1, such that the resistors can be trimmed to achieve intended resistance values.

Trimming is accomplished in well-known manner by use of laser trimming apparatus by which resistive material is selectively volatilized to correspondingly alter the resistance of the resistor elements to achieve an intended specification. It should be evident that the resistor network is easily trimmed after final assembly of the network in an associated circuit package and thus an intended specification for the overall circuit can be achieved, since laser trimming can be accomplished for the overall circuit and not merely for the resistor network alone, as is the case in conventional circuit packages wherein a resistor network is trimmed prior to installation into an associated circuit.

The resistor network is formed by thin film deposition of desired resistive material onto the surface of the substrate, the network being deposited to an intended thickness to achieve an intended resistance value. The formation of such thin film networks is per se known in the art. It is also known that such networks are usually formed to provide a resistance value lower than the final intended value such that by laser trimming the resistance can be increased to achieve the final value.

After trimming of the resistor network to an intended specification, the network is protected by an appropriate coating or layer 20. The protective coating can be, for example, a fiberglass epoxy preform of a size to fit within the aperture 14. This preform is heated to cause flow of the coating material into the spaces between substrate 12 and substrate 16 to seal the network. A passivation layer can be provided over the resistor network prior to trimming for protection of the sensitive network elements. Typically, this passivation layer can be a thermosetting plastic with window areas photolithographically produced therein over the trimmable areas of the network. After trimming, the encapsulated layer can be applied. In mounting the completed circuit package on a circuit board or socket, the standoff portions 40 of leads 22 provide spacing of the underlying circuit pattern on substrate 12 from the confronting mounting surface. If desired, the circuit pattern on substrate 12 can be coated with an insulating protective material.

The fabrication of both substrates 12 and 16 are by well-known single layer deposition techniques. No multilayer deposition need be employed. The invention can be readily implemented and is capable of automated package assembly. The invention does not require any wire bonding of circuit elements and provies an electronic circuit package of a simple and yet rugged construction. It will be appreciated that more than one aperture can be provided within the larger substrate to accommodate trimmable networks or components.

For purposes of laser trimming, the circuit package is supported on the bottom surface of substrate 12; that is, on the surface of substrate 12 facing the surface containing the network to be trimmed. As a result, the network is at a uniform height and orientation with respect to the laser and remains in focus for efficient and accurate trimming. The thickness tolerance of substrate 12 is typically 0.001 to 0.002 inch, and thus the trimmable network can be maintained within an accurately defined plane.

It will be appreciated that the invention is broadly useful in a wide variety of electronic circuit packaging configurations. Although a dual-in-line lead configuration is illustrated, the package can also be of single-in-line form or of any other terminal arrangement which may be desired. Moreover, the invention is also useful with other devices and networks in addition to resistor networks, in which external access is required for trimming or adjustment after circuit assembly. Accordingly, the invention is not to be limited by what has been particularly shown and described except as illustrated in the appended claims.

What is claimed is:

1. An apertured electronic circuit package having two elements comprising:

a first substrate having a circuit pattern thereon and terminating in electrical terminals for connection to external circuitry, the substrate having an aperture therethrough and about the periphery of which a plurality of contact pads are arranged and respectively connected to intended paths of the circuit pattern;

a smaller substrate having a trimmable network thereon connected to a plurality of contact pads disposed on the periphery of the smaller substrate wherein the dimensions of the smaller substrate are sufficient to occlude the aperture and to allow the smaller substrate contact pads to overlap the first substrate pads and said smaller substrate contact pads having a configuration in alignment with the contact pads of said first substrate when the smaller substrate is in a subjacent position relative to said first substrate;

the smaller substrate being mechanically supported by said first substrate wherein the respective contact pads of the smaller substrate also provide electrical connection to the contact pads of the first substrate;

the trimmable network of the smaller substrate being visible and accessible through the aperture in the first substrate to permit trimming of the network to achieve an intended electrical specification.

2. The electronic circuit package of claim 1 further including a protective encapsulating layer provided over the network after trimming of the network by way of the aperture.

3. The electronic circuit package of claim 1 wherein said trimmable network is a network of trimmable film resistors.

4. The electronic circuit package of claim 1 wherein said first and second substrates are each of a ceramic material.

5. The electronic circuit package of claim 1 wherein said first substrate includes electrical terminals arranged along at least one edge thereof.

6. A method of fabricating a two-piece electronic circuit package comprising the steps of:

forming a circuit pattern on a first substrate having an aperture therethrough including forming a plurality of contact pads about the periphery of the aperture;

forming a trimmable network on a smaller substrate including forming a plurality of conact pads about the periphery of the smaller substrate, the smaller substrate having a dimension sufficient to occlude the aperture and to allow the smaller substrate contact pads to overlap the first substrate contact pads having a configuraion in alignment with the contact pads of the first substrate;

aligning the first substrate contact pads to substantially overlap the smaller contact pads;

boding the contact pads of the smaller substrate to the respective contact pads of the first substrate to mechanically support and electrically connect the trimmable network and the circuit pattern;

trimming the network by way of the aperture to achieve an intended electrical specification; and encapsulating the network after the trimming thereof.

7. The method of claim 6 wherein said trimming step comprises laser trimming the network by way of the aperture to achieve an intended electrical specification.

8. The method of claim 7 wherein the step of forming a trimmable network includes forming a network of trimmable film resistors.

9. The method of claim 8 further including providing electrical terminals on said first substrate in electrical connection with said circuit pattern.

10. An apertured electronic circuit package comprising:

a first substrate having an aperture therethrough within the perimeter of the substrate, a plurality of electrical terminals on a substrate surface and disposed along at least one edge of the substrate, a plurality of contact pads on the same substrate surface as said electrical terminals and arranged about the periphery of the aperture, and a circuit pattern on the same substrate surface and selectively interconnecting the electrical terminals and the contact pads;

a second substrate smaller in perimeter than the first substrate and having on one surface thereof a trimmable network terminating in a plurality of contact pads disposed about the periphery of the second substrate, the dimensions of the second substrate being sufficient to allow the second substrate contact pads to overlap the first surface contact pads, and the second substrate contact pads being in alignment with the respective contact pads of the first substrate;

the second substrate being disposed on said first substrate wherein the contact pads of the second substrate substantially overlay the contact pads of the first substrate for mchanically bonding and electrically connecting to respective contact pads of the first substrate;

the trimmable network of the smaller substrate being visible and accessible through the aperture in the first substrate to permit trimming of the network to achieve an intended electrical specification.

11. The electronic circuit package of claim 10 including leads soldered to the electrical terminals of the first substrate for mounting and electrical connection of the circuit package.

12. The electronic circuit package of claim 10 wherein the first substrate includes electrical terminals disposed along opposite edges of the first substrate in dual in-line configuration.

* * * * *